US010994435B2

(12) United States Patent
Zhang

(10) Patent No.: US 10,994,435 B2
(45) Date of Patent: May 4, 2021

(54) SCORE CUTTING TOOL

(71) Applicant: D-CUT PRODUCTS, INC., Oak Brook, IL (US)

(72) Inventor: Charlie Zhang, Oak Brook, IL (US)

(73) Assignee: D-CUT PRODUCTS, INC., Oak Brook, IL (US)

( * ) Notice: Subject to any disclaimer, the term of this patent is extended or adjusted under 35 U.S.C. 154(b) by 16 days.

(21) Appl. No.: 16/158,032

(22) Filed: Oct. 11, 2018

(65) Prior Publication Data

US 2019/0105790 A1 Apr. 11, 2019

Related U.S. Application Data

(60) Provisional application No. 62/570,691, filed on Oct. 11, 2017.

(51) Int. Cl.

| | |
|---|---|
| ***B26D 3/08*** | (2006.01) |
| ***B26D 7/26*** | (2006.01) |
| ***E04F 21/00*** | (2006.01) |
| *B26D 5/10* | (2006.01) |

(52) U.S. Cl.

CPC ..... *B26D 3/08* (2013.01); *B26D 7/2628* (2013.01); *E04F 21/00* (2013.01); *E04F 21/0053* (2013.01); *B26D 5/10* (2013.01)

(58) Field of Classification Search

CPC ..... B23D 3/08; B23D 7/2628; E04F 21/00; E04F 21/0053; B26D 5/10

See application file for complete search history.

(56) References Cited

U.S. PATENT DOCUMENTS

| | | | | | |
|---|---|---|---|---|---|
| 2,294,335 | A * | 8/1942 | Gilbert | B31B 50/00 | 83/614 |
| 3,532,018 | A * | 10/1970 | Szabo | G03B 27/02 | 83/455 |
| 3,699,829 | A * | 10/1972 | Gelfman | B26D 7/01 | 82/92 |
| 3,744,359 | A * | 7/1973 | Gelfman | C03B 33/14 | 82/92 |
| 3,918,337 | A * | 11/1975 | Lindblad | B26D 1/045 | 83/409 |
| 3,996,827 | A * | 12/1976 | Logan | B26F 1/3853 | 83/455 |
| 5,899,133 | A * | 5/1999 | Halladay | A47J 43/00 | 83/467.1 |
| 10,414,684 | B2 * | 9/2019 | Nicholas | B26D 1/01 | |
| 2011/0179929 | A1 * | 7/2011 | Angel | B26D 1/04 | 83/614 |
| 2011/0226111 | A1 * | 9/2011 | Bird | B26D 1/0006 | 83/640 |
| 2014/0000434 | A1 * | 1/2014 | Hasegawa | G02B 6/25 | 83/887 |
| 2014/0165809 | A1 * | 6/2014 | Lin | B27D 5/003 | 83/522.11 |
| 2015/0231791 | A1 * | 8/2015 | Robbins | B26D 3/283 | 83/564 |

(Continued)

*Primary Examiner* — Omar Flores Sanchez
(74) *Attorney, Agent, or Firm* — Pauley Erickson & Swanson

(57) ABSTRACT

A portable tool for scoring a surface of a flexible building material. The tool includes a base receiving a hinged guide for securing the flexible building material. A platform with a blade is slidable relative to the base from a starting position to an end position to score the flexible building material.

25 Claims, 8 Drawing Sheets

(56) References Cited

U.S. PATENT DOCUMENTS

| | | | | |
|---|---|---|---|---|
| 2017/0282394 | A1* | 10/2017 | Hagger | B26D 7/01 |
| 2018/0311855 | A1* | 11/2018 | Gunn | B26D 7/2635 |
| 2019/0030747 | A1* | 1/2019 | Zhang | B26D 7/01 |
| 2019/0049667 | A1* | 2/2019 | Nakamura | G02B 6/25 |
| 2019/0105790 | A1* | 4/2019 | Zhang | B26D 3/08 |
| 2019/0233320 | A1* | 8/2019 | Nicholas | C03B 33/06 |

* cited by examiner

SCORE CUTTING TOOL

CROSS REFERENCE TO RELATED APPLICATION

This application claims the benefit of U.S. Provisional Application, Ser. No. 62/570,691, filed on 11 Oct. 2017. The co-pending parent application is hereby incorporated by reference herein in its entirety and is made a part hereof, including but not limited to those portions which specifically appear hereinafter.

BACKGROUND OF THE INVENTION

Field of the Invention

This invention relates to a cutting tool for scoring flexible materials, preferably rubber, allowing the flexible material to be bent to fit in and around corners and on other non-flat surfaces.

Discussion of Related Art

When installing flexible materials in a home, installers have to score the materials to fit the materials in and around corners and other non-flat surfaces. Currently, installers use a utility knife or another similar tool. However, such tools are inexact, result in variations, and prone to slippage, which may cause the installer to damage the material or cause bodily injury. As such, there is a need for an improved tool for scoring flexible materials.

SUMMARY OF THE INVENTION

The present invention provides a tool for scoring flexible building materials. The scoring tool as described is preferably manufactured from durable materials, such as steel and/or aluminum, that are capable of withstanding repeated cycles of scoring the materials.

In an embodiment of this invention, the scoring tool comprises a base with a receiver having a support surface. The receiver is preferably adjustable and the flexible material is positionable on the support surface within the receiver.

A guide is preferably hingeably connected with respect to the base. The guide is moveable between an open position and a fixable, closed position. The guide preferably includes a linear opening and a pair of guide bars on each side of the linear opening.

A platform is preferably slidable on the guide bars between a starting position and an end position. The platform includes at least one blade, and preferably two blades positioned in a "v-shape" relative to each other, extending toward the base and through the linear opening, when the guide is in the closed position.

The base may also include a mechanism for holding the guide closed and secured in position relative to the base. The base, and specifically the receiver, may also be adjustable allowing the tool to receive and score different sized flexible materials.

BRIEF DESCRIPTION OF THE DRAWINGS

These and other objects and features of this invention will be better understood from the following detailed description taken in conjunction with the drawings, wherein.

DESCRIPTION OF THE INVENTION

Figure 1:
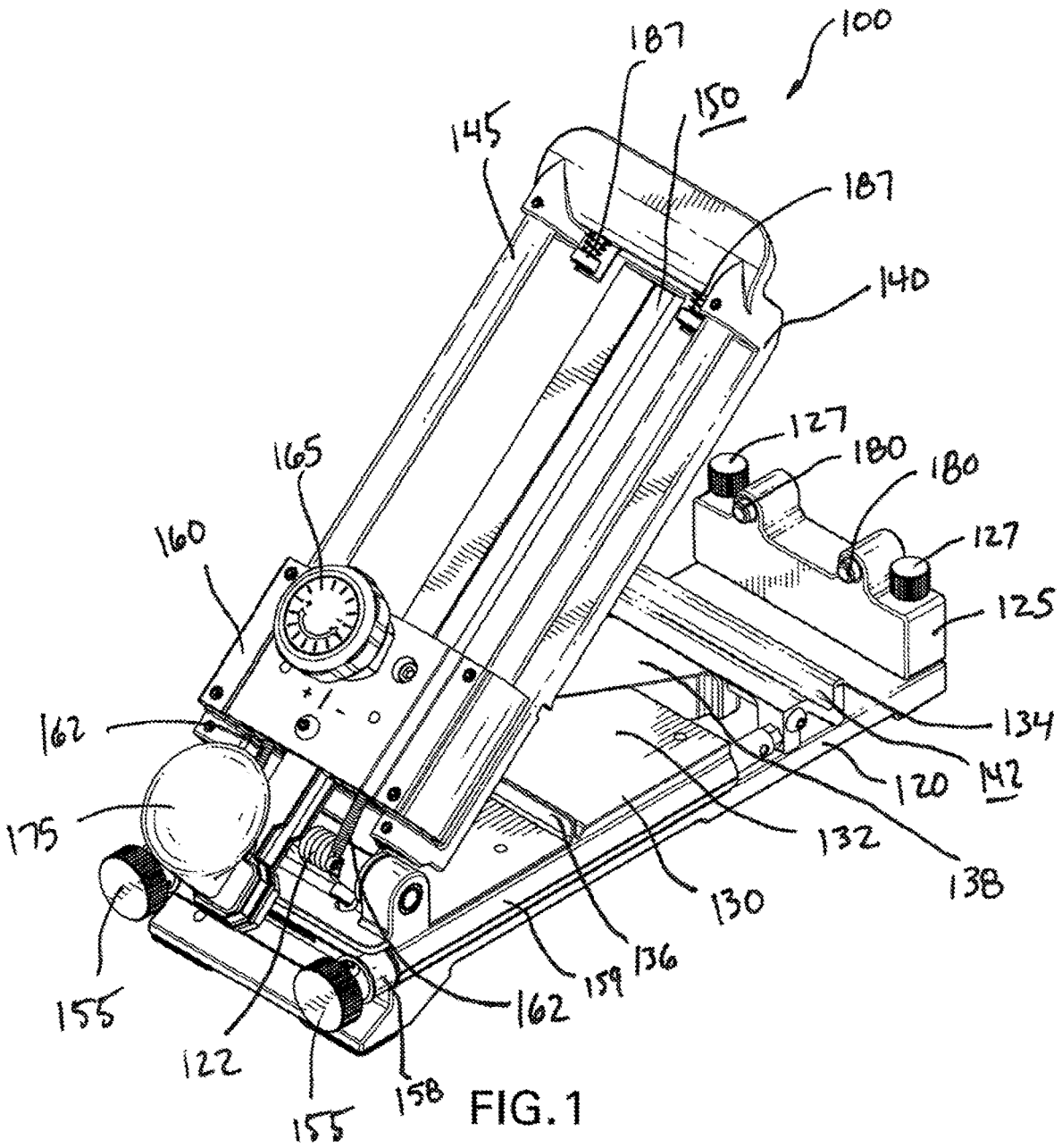
FIG. 1 is a perspective view of a scoring tool according to one embodiment of this invention with a guide in an open position relative to a base.

FIGS. 1-8 show a scoring tool 10 according to an embodiment of this invention.

The tool as described is preferably used to score flexible building materials 100, such as, but not limited to, rubber coves, planks, baseboards, and other trim, allowing the flexible material to more easily bend around corners, fit in corners, and/or be adapted to fit against other non-flat surfaces.

The scoring tool of this invention preferably includes a base 120, a guide 140, and a platform 160. The scoring tool is preferably manufactured from durable materials that are capable of withstanding the repeated stress of scoring flexible materials, such as steel and aluminum.

As shown in the figures, the base 120 includes a receiver 130 having a support surface 132. The receiver 130 is preferably adjustable to accommodate a range of building materials and sizes. More specifically, a width of the receiver is preferably adjustable. The flexible material is thus positionable on the support surface 132 within the receiver 130 as shown in FIG. 2.

Figure 2:
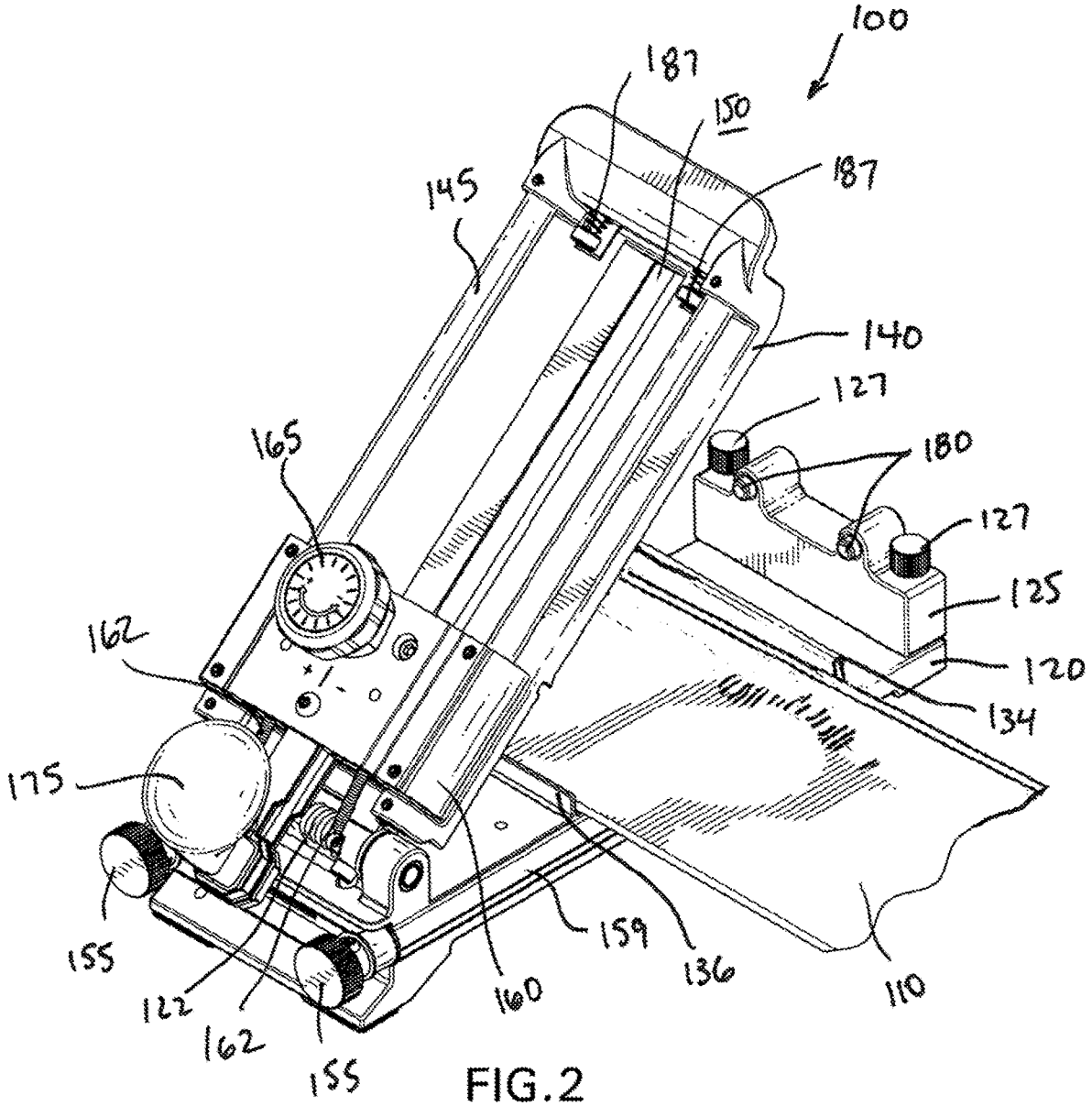
FIG. 2 is another perspective view of the scoring tool shown in FIG. 1 with a flexible building material positioned in the receiver.
Figure 3:
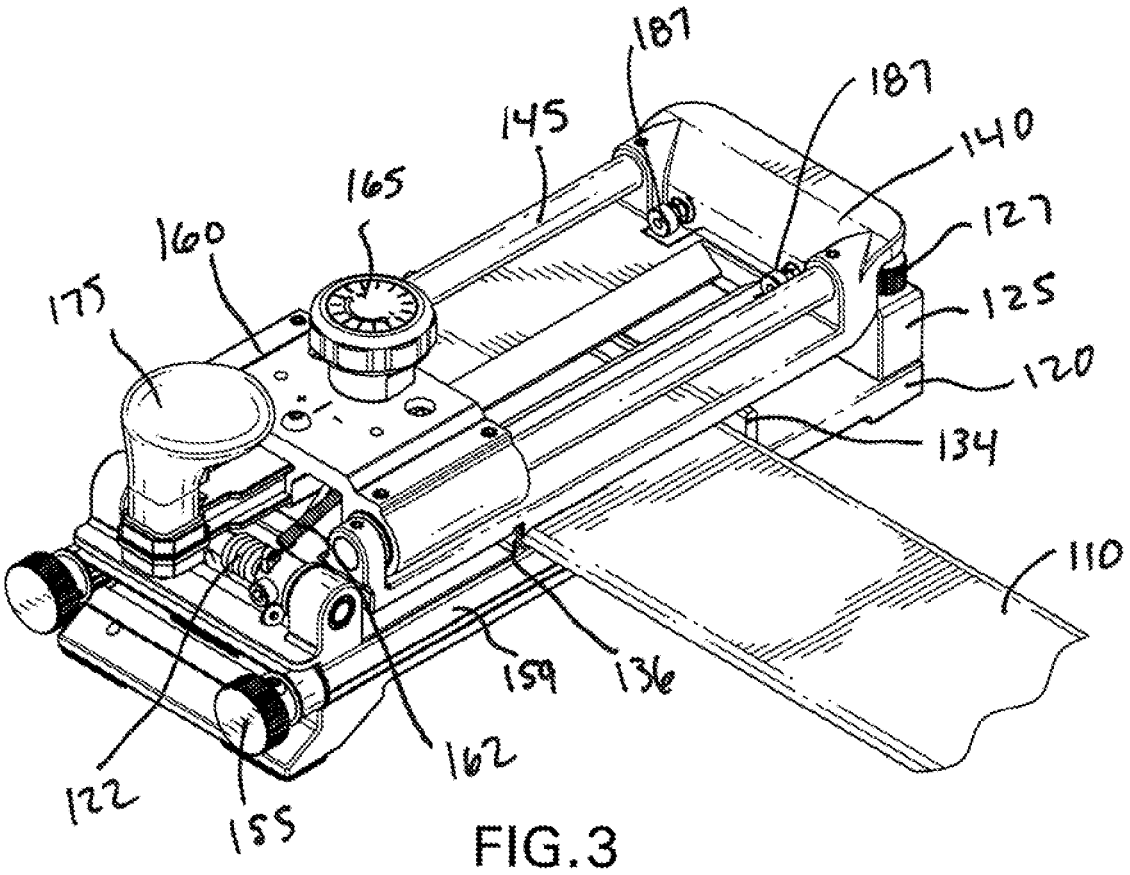
FIG. 3 is a perspective view of the scoring tool shown in FIG. 2 with the guide in the closed position relative to the base and a platform in a starting position.
Figure 4:
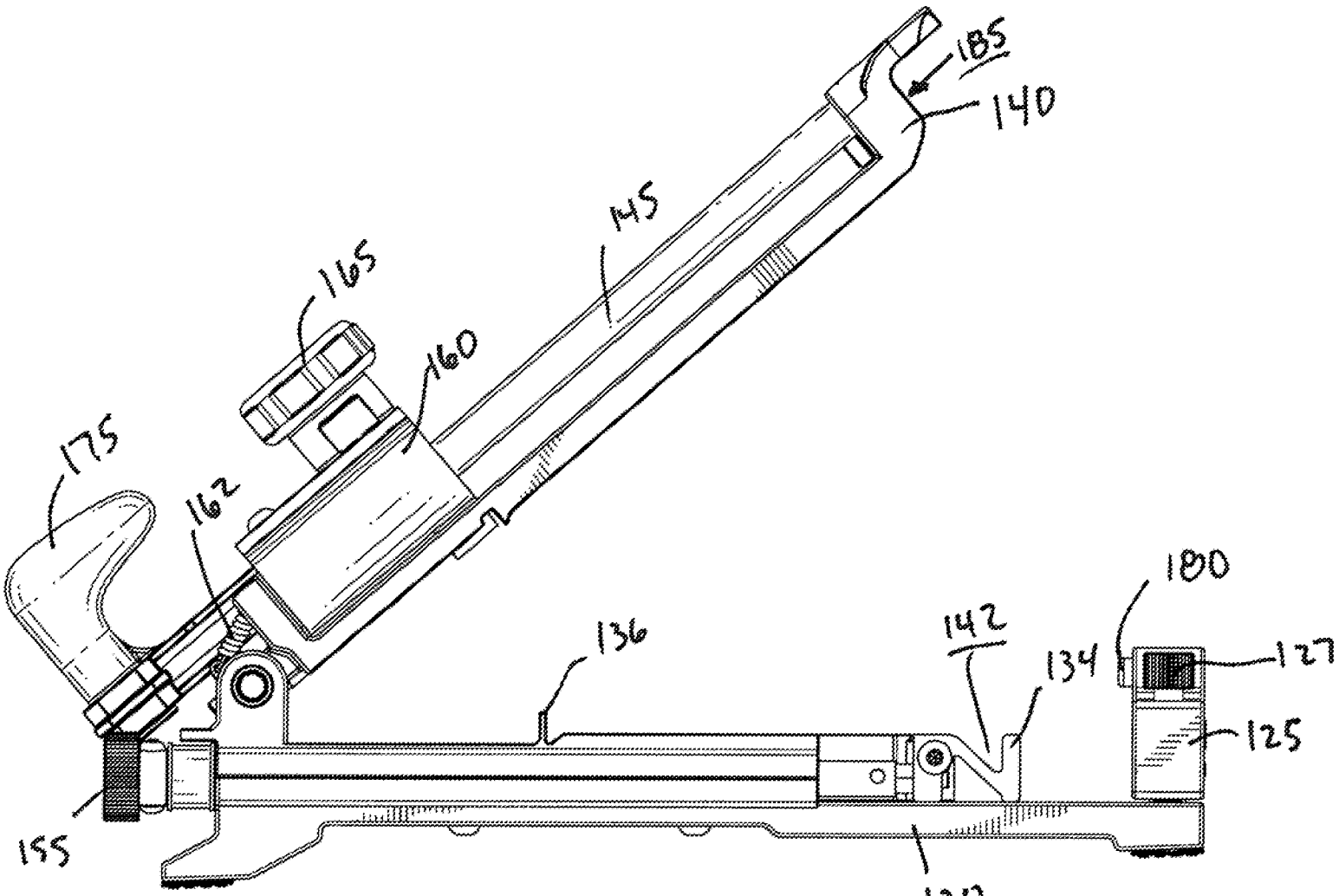
FIG. 4 is a side view of the scoring tool in the position shown in FIG. 1.
Figure 5:
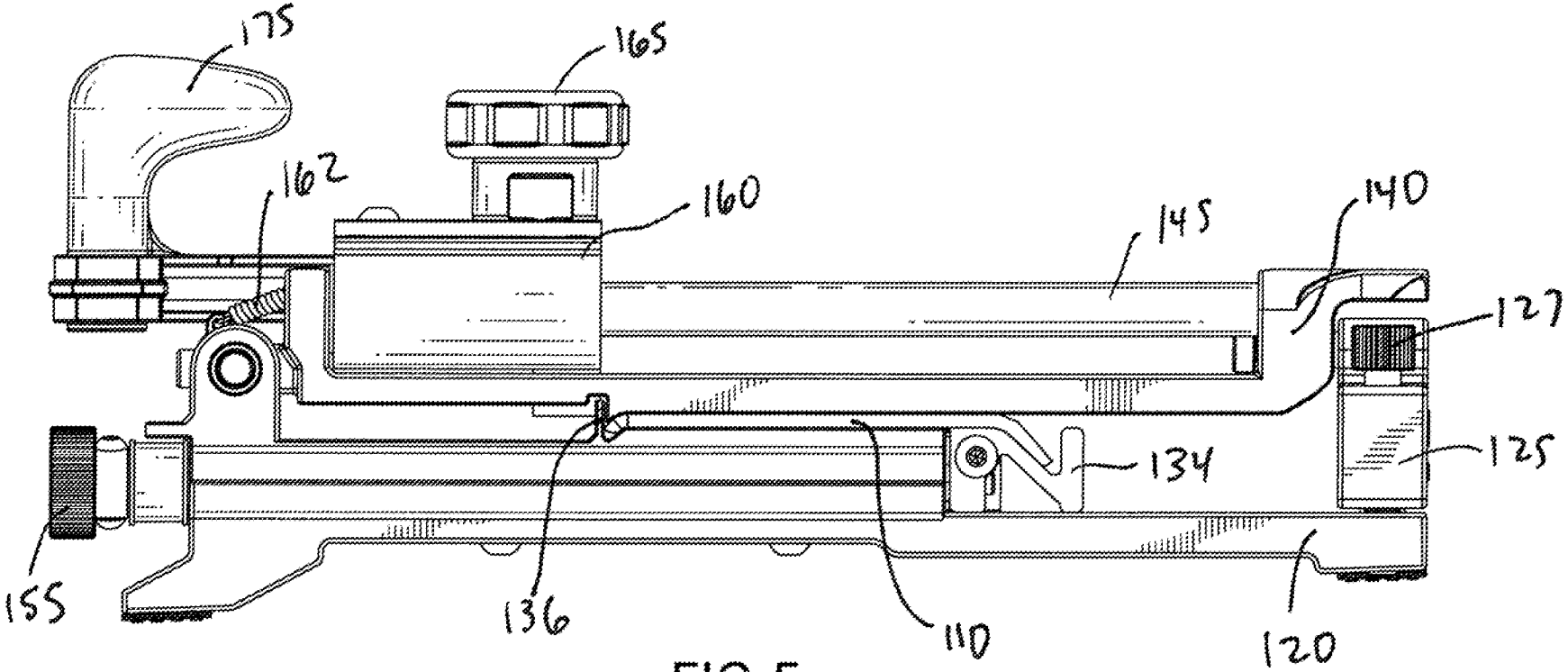
FIG. 5 is a side view of the scoring tool in the position shown in FIG. 3.

As shown best between FIGS. 2 and 3, the guide 140 is preferably hingeably connected with respect to the base 120. In this manner, the guide 140 preferably includes a free end and a hinged, connected end forming a clamshell type engagement. The guide 140 is thus moveable between an open position as shown in FIGS. 1 and 2 and a closed position shown in FIG. 3. In an embodiment, the hinged connection may include a spring 122 or similar bias mechanism to maintain the guide 140 in the open position relative to the base 120. The guide 140 preferably further includes a linear opening 150.

A platform 160 is preferably slidable on the guide 140 between a starting position and an end position. Here also, one or more springs 162 may be employed to maintain the platform 160 in the starting position relative to the guide 140. The platform 160 further includes at least one blade 170 extending toward the base 120 and through the linear opening 150, preferably when the guide 140 is in the closed position.

Figure 8:
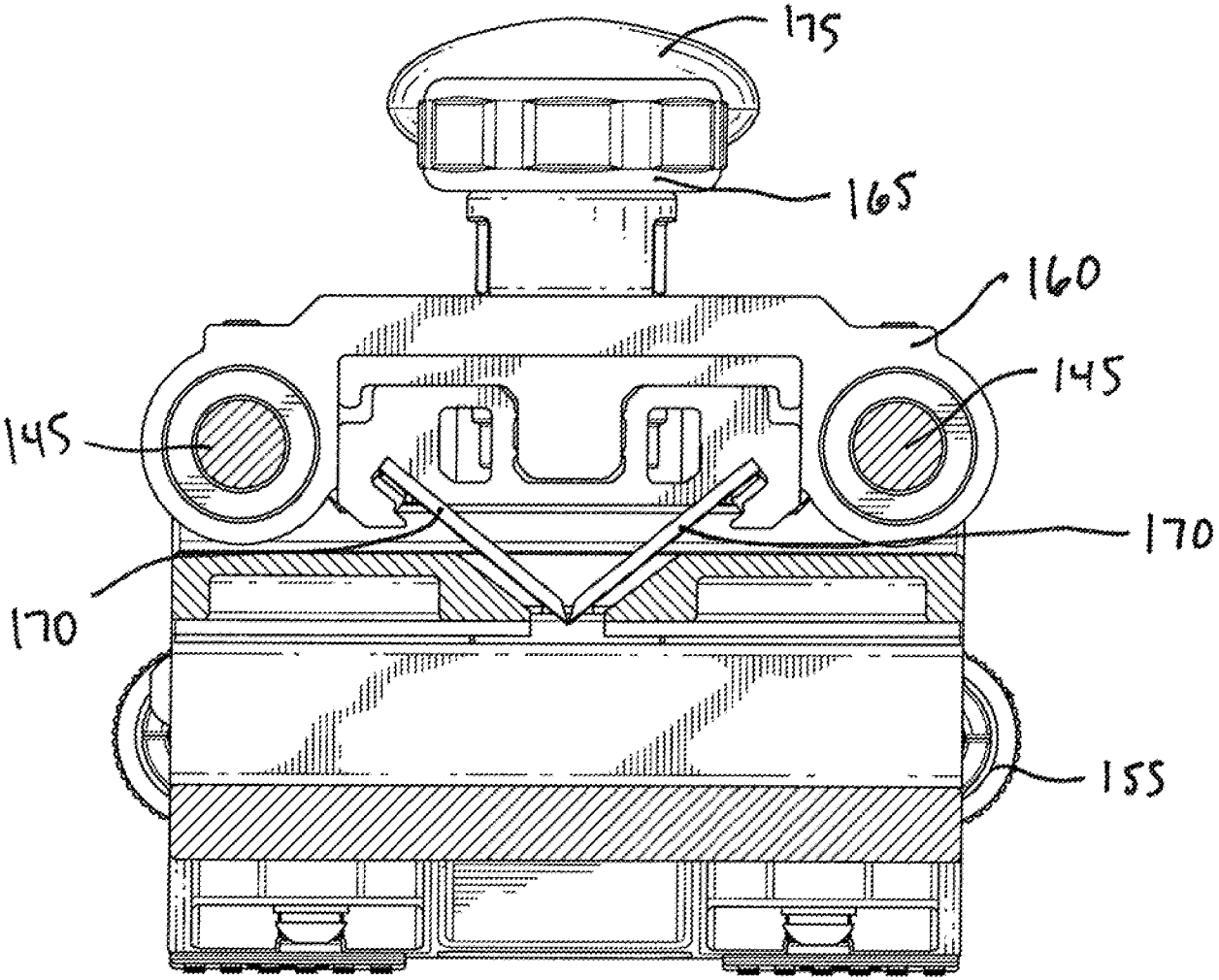
FIG. 8 is a front cross-sectional view of the scoring tool shown in FIG. 3.

According to one embodiment the at least blade 170 comprises a pair of blades, wherein the blades 170 are set at an angle relative to each other. As best shown in FIG. 8, the blades 170 converge below the guide 140 and meet near the opening 150. As shown in the figures, a depth adjustment wheel 165 may be positioned relative to the platform 160 for adjusting a depth of the at least one blade 170. As shown in FIG. 8, the depth of the blade(s) 170 may be anywhere between a top edge of the opening 150 and to and beyond a bottom edge of the opening 150. This depth may be adjustable depending on the material 110 and a depth of the scoring required relative to the composition and/or thickness of the material 110.

In a preferred embodiment, the blades 170 are set at a 94 degree angle to each other. Alternatively embodiments may comprise an 88 degree angle or any other angle to provide a desired score in the flexible material. Alternative embodiments, may include a curved blade or another shaped blade for making the score line in the material.

Figure 6:
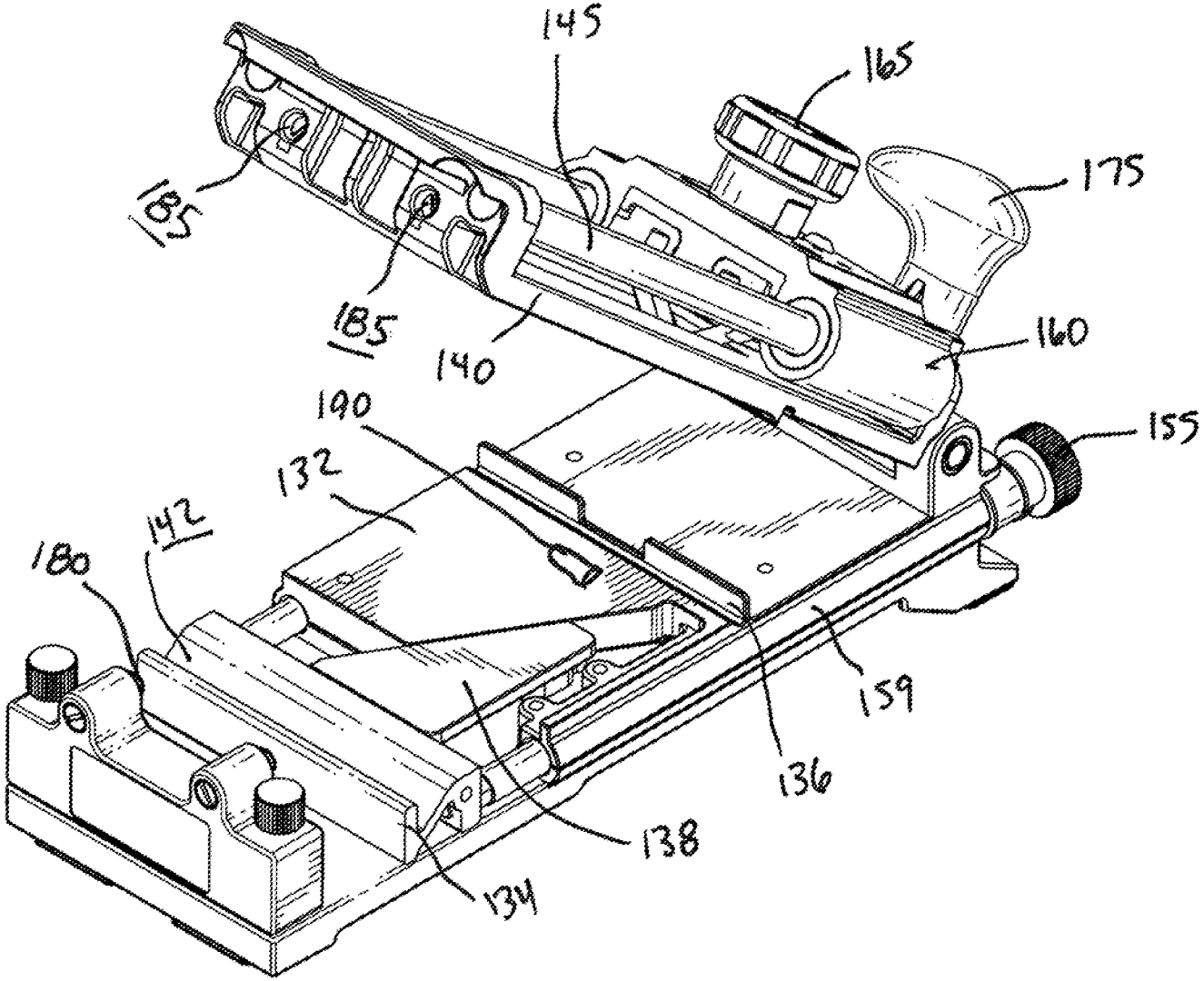
FIG. 6 is an opposite perspective view of the scoring tool shown in FIG. 1 wherein the receiver is partially expanded.
Figure 7:
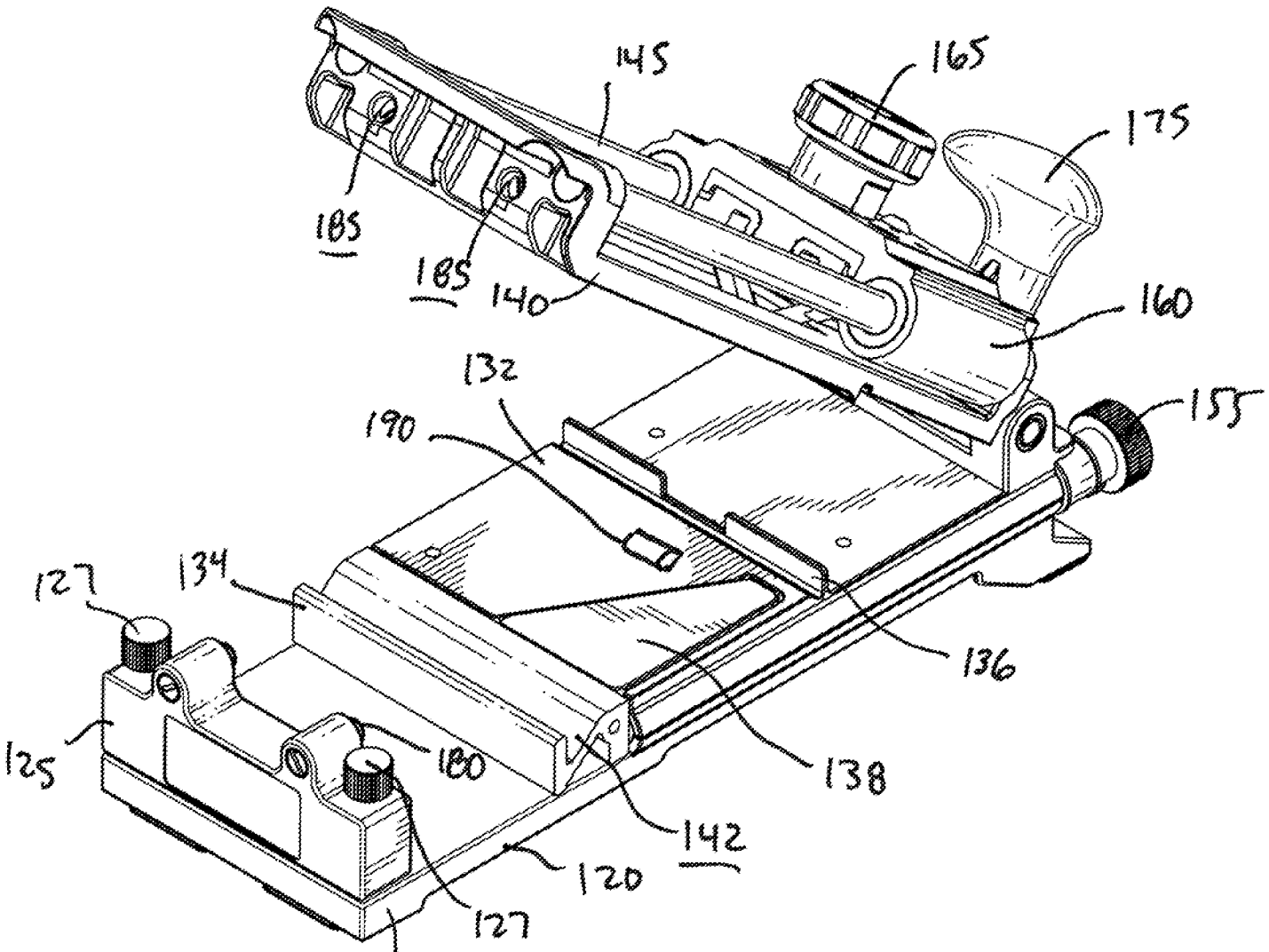
FIG. 7 is an opposite perspective view of the scoring tool shown in FIG. 6 wherein the receiver is fully contracted.

According to embodiments best shown in FIGS. 6 and 7, the tool 100 may include an adjustable receiver 130 that comprises a fixed wall 136 and a moveable wall 134. The fixed wall 136 is preferably located closest to the hinged connection between the guide 140 and the base 120. The opposite, moveable wall 134 is thus positioned closest to an open end of the base, more specifically toward a base block 125, described in more detail below. As shown in FIGS. 6 and 7, the moveable wall 134 including a groove 142. Specifically, as shown, the support surface 132, extends downward into the groove 142 adjacent the moveable wall 134.

As shown in FIGS. 6 and 7, the receiver 130 may further comprise a moveable support 138 that extends an effective length of the support surface 132 between the moveable wall 134 and at least a portion of the receiver 130. As shown, the moveable support 138 is generally triangular shaped although any preferred shape may be employed that effectively extends the support surface 132 width to a fully expanded position of the receiver 130.

As best shown in FIGS. 6 and 7, a riser 190 may be positioned on the support surface 132 to bring the material 110 into closer engagement with an area of where the blades 170 will engage the material 110. This riser 190 is intended to provide a focused increase in a height of the support surface 132 in an area of the score, preferably in line with a scoreline and a path of movement of the blades 170.

As shown in the figures, at least one knob 155, and as shown two knobs 155, are used for adjusting a width of the receiver 130. In an embodiment having two knobs 155, the knobs may be joined with a timing belt 158 to coordinate movement of the moveable wall 134 between adjustment screws 159. In this manner, the receiver 130 may be adjusted between the narrowest and widest material 110 desirable. More specifically, a range between approximately 4" and 6¼" of materials 110 may be placed within the receiver 130 for scoring.

As briefly described above, the base 120 may further include a base block 125 that connects to one end of the base 120 and is connectable with respect to a free end (i.e., the non-hinged end) of the guide 140. The base block 125 preferably engages with the guide 140 when the guide 140 is moved into the closed position. In one preferred embodiment, the guide 140 locks into the base block 125 when the guide 140 is lowered into engagement with the base 120.

According to one preferred embodiment, the base block 125 includes having a fine height adjustment relative to the base 120. Specifically, one or more thumb wheels 127 may be positioned through the base block 125 to adjust a height of the base block 125 relative to the base 120. In this manner, a user may control a height at which the guide 140 locks into the base 120 depending on the material 110 to be scored.

In one preferred embodiment, a pair of biased pins 180, best shown in FIGS. 1 and 2 are located in the base block 125. A corresponding set of receiving apertures 185, best shown in FIGS. 6 and 7 are positioned in the guide 140 and lock into position with the biased pins 180. The closed position of the guide 140 relative to the base 120 is thus preferably locked during the scoring operation. Following the scoring operation, in one preferred embodiment, the platform 160 contacts a pair of ejector pins 187 to release the biased pins 180 from the receiving apertures 185. In this manner, following the scoring operation, the guide 140 is automatically released from engaged with the base 120.

As shown in the figures, the guide 140 of this embodiment includes a pair of guide bars 145. The guide bars 145 preferably include a low-friction surface and/or bearings or another device to allow the platform 160 to easily slide along the guide 140. A handle 175 may be positioned on the platform 160 for ease of sliding operation. The guide bars 145 also preferably restrict movement of the platform 160 along a linear path to provide a straight score in the flexible material 110.

In operation, the scoring tool of this invention starts in the position shown in FIG. 1. A user sets the material 110 to be scored in the tool, as shown in FIG. 2. The guide 140 is swung down along a hinge with the base 120 and onto the base 120 and the material 110, securing the material 110, and preferably locking the receiver in place with the biased pins 180 and the receiving apertures 185. The user then grasps the handle 175 in the start position, as shown in FIG. 3, and slides the platform 160 across the guide 140 until the platform 160 reaches the end position scoring the material 110. When the platform 160 reaches the end position, the platform 160 preferably disengages the biased pins 180 from the guide 140 using the ejector pins 181, allowing the guide 140 to open as the platform 160 retreats to the starting position, shown in FIG. 1.

Therefore, a method of scoring a flexible building material may comprise providing the base 120 with the receiver 130 and providing the flexible material 110 within the receiver 120. Next, a user closes the guide 140 that is hingeably connected with respect to the base 120 to contain the flexible material 110. Next, the user slides the platform 160 along the guide 140 between a starting position and an end position, wherein the platform 160 includes at least one blade 170 extending toward the base 120. Finally, the user scores the flexible material 110 with the blade 170 as it passes over the material 110.

As described above, the free end of the guide 140 may be locked to the base 120 upon closure of the guide 140. Also, once the platform 160 is slid to the end position, the free end of the guide 140 may be automatically released from the base 120.

While in the foregoing specification this invention has been described in relation to certain preferred embodiments thereof, and many details have been set forth for purpose of illustration, it will be apparent to those skilled in the art that the material cutter is susceptible to additional embodiments and that certain of the details described herein can be varied considerably without departing from the basic principles of the invention.

What is claimed is:

1. A tool for scoring a flexible building material, the tool comprising:

a base with a receiver having a support surface, wherein the receiver is adjustable and the flexible material is positionable on the support surface within the receiver;

at least one knob for adjusting a width of the receiver;

a guide hingeably connected with respect to the base, the guide including a linear opening, wherein the guide is fixable in a closed position;

a platform slidable on the guide from a starting position to an end position, the platform including at least one blade extending toward the base and through the linear opening in the closed position.

2. The tool of claim 1 wherein the at least one blade comprises a pair of blades, wherein the blades are set at an angle relative to each other.

3. The tool of claim 2 wherein the pair of blades converge below the guide.

4. The tool of claim 1 further comprising a depth adjustment wheel positioned on the platform for adjusting a depth of the at least one blade.

5. The tool of claim 1 further comprising a base block that connects with respect to a free end of the guide, the base block having a height adjustment.

6. The tool of claim 5 wherein the base block includes at least one locking pin for locking the guide into the closed position.

7. The tool of claim 1 wherein the receiver further comprises a fixed wall and a moveable wall.

8. The tool of claim 7 wherein the moveable wall includes a groove.

9. The tool of claim 8 wherein the receiver further comprises a moveable support that extends a width of the support surface between the moveable wall and at least a portion of the receiver.

10. The tool of claim 9 wherein the moveable support is generally triangular shaped.

11. A scoring tool for scoring a flexible building material, the scoring tool comprising:

a base with a receiver, wherein the receiver is adjustable and the flexible material is securable within the receiver and wherein the receiver further comprises a fixed wall and a moveable wall, wherein the receiver further comprises a moveable support that extends a width of a support surface between the moveable wall and at least a portion of the receiver;

a guide hingeably connected with respect to the base, the guide including a pair of linear guide bars and a linear opening positioned between the guide bars, wherein the guide is moveable between an open position and a closed position, wherein in the closed position the guide is generally parallel with the base; and a platform slidable on the guide bars between a starting position and an end position, the platform including a pair of blades arranged in a v-shape and extending toward the base and through the linear opening when the guide is in the closed position.

12. The tool of claim 11 further comprising at least one knob for adjusting a width of the receiver.

13. The tool of claim 11 further comprising a base block that connects with respect to a free end of the guide, the base block having a height adjustment.

14. The tool of claim 13 wherein the base block includes at least one locking pin for locking the guide into the closed position.

15. A method of scoring a flexible building material, the method comprising:

providing a base with a receiver;

providing the flexible material within the receiver;

closing a guide that is hingeably connected with respect to the base to contain the flexible material;

sliding a platform along the guide between a starting position and an end position, the platform including at least one blade extending toward the base;

scoring the flexible material with the blade; and wherein, once the platform is slid to the end position, a free end of the guide is released from the base.

16. The method of claim 15 wherein a free end of the guide is locked to the base upon closure of the guide.

17. The method of claim 15 further comprising adjusting a width of the receiver.

18. The method of claim 15 further comprising adjusting a height of the at least one blade.

19. A tool for scoring a flexible building material, the tool comprising:

a base with a receiver having a support surface, wherein the receiver is adjustable and the flexible material is positionable on the support surface within the receiver;

a guide hingeably connected with respect to the base, the guide including a linear opening, wherein the guide is fixable in a closed position;

a platform slidable on the guide from a starting position to an end position, the platform including at least one blade extending toward the base and through the linear opening in the closed position; and wherein the receiver further comprises a fixed wall and a moveable wall, the moveable wall including a groove.

20. The method of claim 19 wherein, once the platform is slid to the end position, a free end of the guide is released from the base.

21. The tool of claim 19 wherein the receiver further comprises a moveable support that extends a width of the support surface between the moveable wall and at least a portion of the receiver.

22. The tool of claim 21 wherein the moveable support is generally triangular shaped.

23. A scoring tool for scoring a flexible building material, the scoring tool comprising:

a base with a receiver, wherein the receiver is adjustable and the flexible material is securable within the receiver;

at least one knob for adjusting a width of the receiver;

a guide hingeably connected with respect to the base, the guide including a pair of linear guide bars and a linear opening positioned between the guide bars, wherein the guide is moveable between an open position and a closed position, wherein in the closed position the guide is generally parallel with the base;

a platform slidable on the guide bars between a starting position and an end position, the platform including a pair of blades arranged in a v-shape and extending toward the base and through the linear opening when the guide is in the closed position.

24. A tool for scoring a flexible building material, the tool comprising:

a base with a receiver having a support surface, wherein the receiver is adjustable and the flexible material is positionable on the support surface within the receiver, and wherein the receiver further comprises a moveable support that extends a width of the support surface between a moveable wall and at least a portion of the receiver;

a guide hingeably connected with respect to the base, the guide including a linear opening, wherein the guide is fixable in a closed position;

a platform slidable on the guide from a starting position to an end position, the platform including at least one blade extending toward the base and through the linear opening in the closed position.

25. The tool of claim 24 wherein the moveable support is generally triangular shaped.

* * * * *